United States Patent [19]

Hedrick

[11] Patent Number: 4,513,519

[45] Date of Patent: Apr. 30, 1985

[54] ADJUSTABLE SHOE TAP

[76] Inventor: George Hedrick, 14 Ponderosa Dr., Melville, N.Y. 11747

[21] Appl. No.: 514,081

[22] Filed: Jul. 15, 1983

[51] Int. Cl.[3] ..... A43B 5/12

[52] U.S. Cl. ..... 36/113; 36/8.3; 36/139

[58] Field of Search ..... 36/8.3, 139, 113, 114, 36/136

[56] References Cited

U.S. PATENT DOCUMENTS

| | | | |
|---|---|---|---|
| Re. 20,472 | 8/1937 | Landi | 36/8.3 |
| 1,967,334 | 7/1934 | Sothen | 36/8.3 |
| 2,124,908 | 7/1938 | Capezio | 36/8.3 |
| 2,168,303 | 8/1939 | Sothen | 36/8.3 |
| 2,443,727 | 6/1948 | DuMont et al. | 36/8.3 |
| 2,479,428 | 8/1949 | Sunseri | 36/8.3 |
| 3,878,641 | 4/1975 | Noble | 36/139 X |

*Primary Examiner*—Henry S. Jaudon
*Assistant Examiner*—Tracy Graveline

[57] ABSTRACT

A dancing tap comprising three elements arranged in such a way as to require no external apparatus for assembly. There is recited a first plate-like body having a central through bore and multiple recesses on its first and second faces, a second plate-like body received by the central through bore of the first plate-like body and containing multiple protrusions, a sound spring equipped with a dimple that mates with a protrusion on the second face of the second plate-like body. The protrusion of the second plate-like body hitting the periphery of the dimple on the sound spring produces a novel tapping sound.

3 Claims, 6 Drawing Figures

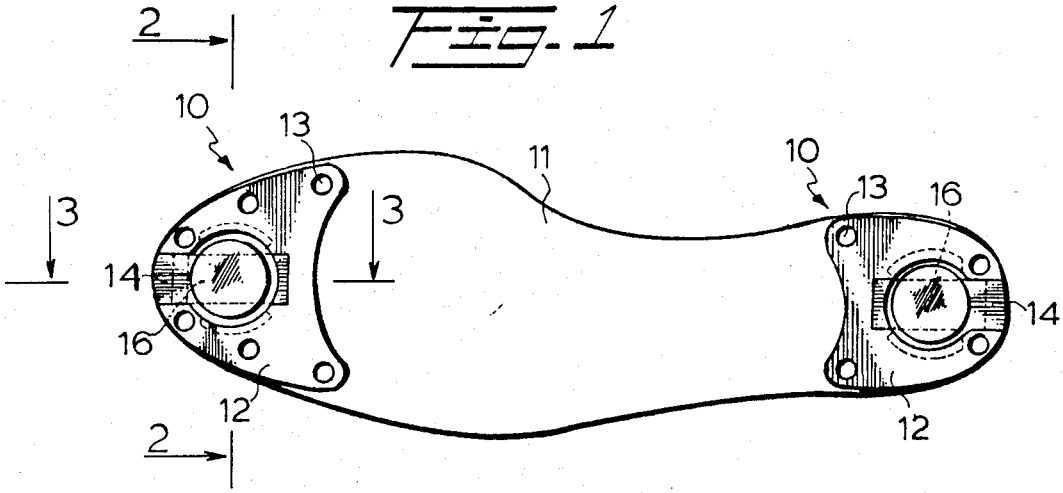
Fig. 1
Fig. 3
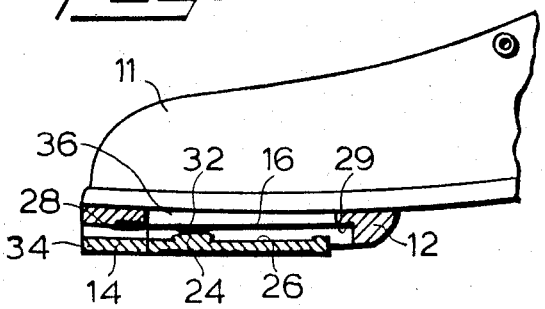
Fig. 4
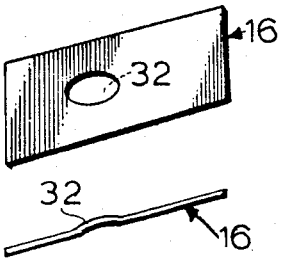
Fig. 5
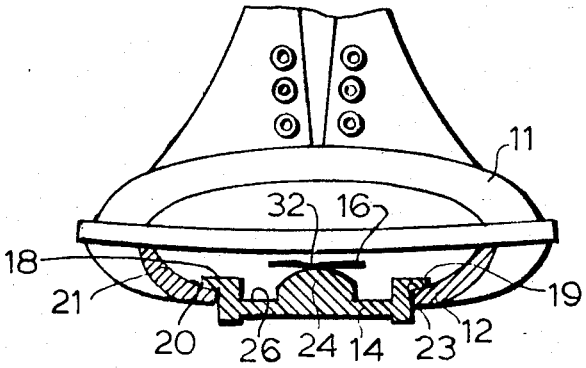
Fig. 2

ADJUSTABLE SHOE TAP

BACKGROUND OF THE INVENTION

This invention relates to dancing taps but more particularly to a dancing tap that mounts external to any "off the shelf" shoe and contains three elements that are self affixed.

Taps are ordinarily made in the form of small plates and are attached to the soles and/or heels of shoes worn by persons engaged in dancing, particularly in tap dancing. The purpose of taps is to produce a distinct sound, the sound being produced by the impact of the tap against the dance floor. The sound produced by the taps accentuates the rhythm of the dance and adds materially to the enjoyment of persons watching the dance. This rhythmic sound of the tap dancing is particularly important to persons who do not see the dancer but who only listen to the dance, that is, to the rhythmic taps.

It was generally recognized that the quality of the tap produced by the impact against the floor may vary and that one particular quality of the sound may be more attractive than another.

The known dancing taps of this type, are usually plate-like in form and are provided with a sound amplifying chamber and have no sound creating elements or only weak ones in the chamber, and furthermore have the sound outlet positioned under the bottom of the shoe, whereby the outlet becomes restricted by the overhanging shoe bottom. Thus, the sound emitted from the chamber is obliged to pass between the sole or the bottom of the shoe and the floor, which tends to muffle and deaden the metallic sound created in the chamber.

In the art there are various shoe taps found. In U.S. Pat. Nos. 1,809,107, 2,011,435 to Capezio and U.S. Pat. No. 1,780,230 to Haney there is taught the use of a one piece tap attached externally to the shoe and making use of different contours to vary the tapping sound. In the more recent state of the art there are provided multiple element taps also attached to the exterior of the shoe and containing movable parts to further increase the tapping sound. For instance, U.S. Pat. No. 1,868,765 to Reynolds teaches a multi-element tap that makes use of ball bearings to transfer activating force, but provides no means for lubricating the ball bearings to insure longevity. U.S. Pat. No. 2,168,303 to Sothen also teaches a multi-element tap that makes use of a spinning means to facilitate easy and graceful turning and spinning of the dancer in either direction. With this arrangement numerous other elements are necessary to support and maintain its operation. This multitude of parts raises the chances of malfunction and/or deterioration of operation; this reduces its practicality. Other variations of taps require special shoes. U.S. Pat. No. 1,997,221 to Landi teaches a tap mechanism that is recessed into the sole of the shoe, and U.S. Pat. No. 1,668,505 to Haney teaches a tap mechanism that is recessed into the heel of the shoe.

SUMMARY OF THE INVENTION

It is an object of the present invention to provide a self-sounding tap to aid tap dancers in amplifying the sound of the tap when tap dancing or other forms of dancing is exercised.

Another object of the present invention is to provide a dancing tap whose sound can be altered by changing the configuration and thickness of the sound spring.

Still another object of the present invention is to provide a dancing tap that simplifies the manufacture by limiting the assembly to three parts, and also, due to the nature of the design, will form the product without the use of fastening devices, such that it may be readily affixed to any "off the shelf" shoe.

Still another object of the present invention is to provide a dancing tap constructed of a first plate-like body, a second plate-like body and a sound spring.

Another object of the present invention is to provide a dancing tap whose first plate-like body contains a through bore and recesses on both of its faces, whose second plate-like body contains an extension and two protrusions from its sides so as to allow the protrusions to be received by the recesses on the second face of the first plate-like body and the side extension of the second plate-like body to be received by the recess on the first face of the first plate-like body.

Yet still another object of the present invention is to provide a dancing tap whose sound spring lies between the first and second plate-like bodies and is attached in the recesses on the first face of the first plate-like body.

A further object of the present invention is to provide a dancing tap whose second plate-like body contains a protrusion that is adapted to coact with a dimple disposed on the sound spring to alter the tapping effect.

BRIEF DESCRIPTION OF THE DRAWING

FIG. 1 is a bottom plan view of the present invention attached to a conventional shoe;

FIG. 2 is a view of the present invention partially in front elevation and partially in section along line 2—2, in FIG. 1, wherein the constructional assembly of the tap of this invention is shown at an enlarged scale relative to the shoe;

FIG. 3 is a view of the present invention partially in side elevation and partially in section along line 3—3 in FIG. 1, wherein the constructional assembly of the tap of this invention is shown at an enlarged scale relative to the shoe;

FIG. 4 is a perspective view of the sound spring of the present invention shown in FIG. 1;

FIG. 5 is a side view of the sound spring of the present invention shown in FIG. 1

DESCRIPTION OF THE PREFERRED EMBODIMENT

Figure 6:
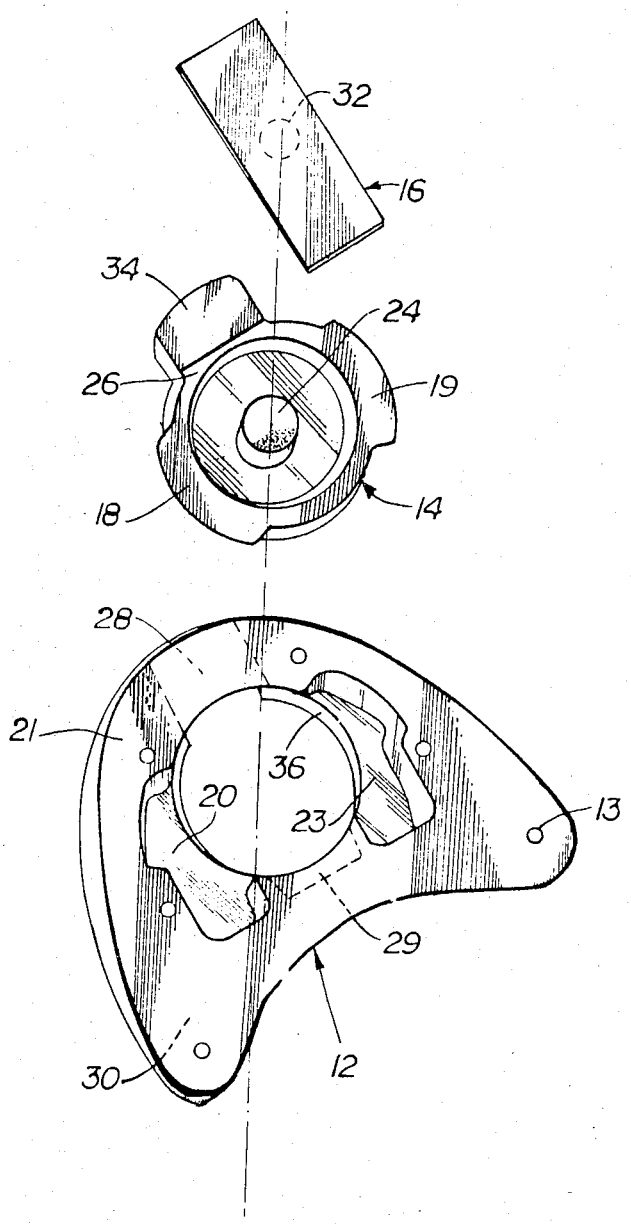
FIG. 6 is an explosive view in perspective illustrating how the arrangement of the invention is assembled.

Referring now to FIG. 1 the dancing tap is shown generally at 10 attached to a shoe 11 and having a first plate-like body 12 preferably made out of aluminum, a second plate-like body 14 also preferably made out of aluminum and a sound spring 16 preferably made of spring steel.

In FIGS. 2,3 and 6 one can see the actual assembled construction of the dancing tap 10. Second plate-like body 14 lies in central through bore 36 of first plate-like body 12 so that protrusions 18 and 19 on the second face 26 of the second plate-like body 14 fit into recesses 20 and 23 on the second face 21 of first plate-like body 12. Second plate-like body 14 includes a central post 24 on its second face 26. Sound spring 16 fits into recesses 28 and 29 on first face 30 of first plate-like member 12. A side extension 34 of second plate-like body 14 fits into recess 28 of first plate-like body 12 to complete the constructional assembly.

In operation, second plate-like body 14 is articulated by the tapping of the foot on the floor. Additionally, post 24 on second face 26 of second plate-like body 14 forces dimple 32 on sound spring 16 to flex which causes spring 16 to flex and thereby greatly increases the tapping sound. The tapping sound can be varied by changing the thickness of sound spring 16 and the configuration of sound spring 16 with respect to relative positioning of dimple 32 and post 24. It is to be appreciated that due to the simple construction (three elements) of the tap, sound spring 16 can be easily removed, replaced, and repositioned to obtain the tapping effect preferred. The dancing tap 10 may be attached to a shoe 11 by using nails or screws positioned through peripheral through bores 13. Alternatively dancing tap 10 may also be attached to a shoe 11 by the use of epoxy cement.

Although the invention is illustrated and described with reference to a preferred embodiment thereof, it is to be expressly understood that it is in no way limited to the disclosure of such preferred embodiment but is capable of numerous modifications within the scope of the appended claims.

We claim:

1. A dancing tap for attachment to the sole or heel of a dancing shoe, comprising:

(a) a first plate-like body having a first and second face, a central through bore and means for attaching the first body to a shoe;

(b) a second plate-like body having a first and second face and constructed to be received in said central through bore of said first plate-like body and which is adapted to be articulated relative to said first body; and (c) a sound spring operatively mounted in said first plate-like body so as to be movable by said second plate-like body which creates a tapping sound when said second plate-like body articulates about said first body and flexes said sound spring; said first plate-like body contains first and second recesses on said first face and third and fourth recesses on said second face, both originating at said central through bore; said second plate-like body has a first and second protrusion extending from its second face, so as to allow said first and second protrusions of said second plate-like body to be received by said third and fourth recesses on said second face of said first plate-like body; said sound spring is disposed between said first and second plate-like bodies and is movably mounted at said first and second recesses on said first face of said first plate-like body so that said sound spring can flex and be easily removed or replaced.

2. A dancing tap as in claim 1, wherein said second plate-like body is provided with a post on its second face that is adapted to impinge on the periphery of a dimple on said sound spring, so disposed that the articulation of said second plate-like body will cause said post to invert said dimple and create a novel tapping sound.

3. A dancing tap for attachment to the sole or heel of a shoe comprising:

(a) a first plate-like body having a first and second face, a central through bore and means for attaching the first body to a shoe; said first plate-like body having first and second recesses on said first face, and third and fourth recesses on said second face, both originating at said central through bore;

(b) a second plate-like body having a first and second face and constructed to be received in said central through bore of said first plate-like body and which is adapted to be articulated relative to said first body; said second face of said second plate-like body having extending therefrom a first and second protrusion, said protrusions adapted to be received by said third and fourth recesses on said second face of said first plate-like body; and (c) a sound spring operatively mounted in said first plate-like body so as to be movable by said second plate-like body, which creates a tapping sound when said second plate-like body articulates about said first plate-like body and flexes said sound spring, wherein said first face of said second plate-like body has extending therefrom at least one side extension adapted to be received by at least one of said first and second recesses on said first face of said first plate-like body, such that said second plate-like body may be more readily articulated with respect to said first plate-like body; said first plate-like body, second plate-like body and sound spring being assembled so as to interengage each other but not being disconnected from each other, so that upon removing the means for attaching the first body from a shoe said interengaged assembly can be manually disassembled.

* * * * *